United States Patent [19]

Brown

[11] Patent Number: 4,928,361

[45] Date of Patent: May 29, 1990

[54] PAPER CLIP

[76] Inventor: James Brown, 2330-10 Grove Ave., San Diego, Calif. 92154

[21] Appl. No.: 418,521

[22] Filed: Oct. 10, 1989

[51] Int. Cl.[5] ..... B42F 1/02

[52] U.S. Cl. ..... 24/67.9; 24/67 R; 24/545

[58] Field of Search ..... 24/67.1, 67 R, 67.9, 24/67.11, 545, 30.5

[56] References Cited

U.S. PATENT DOCUMENTS

| | | | |
|---|---|---|---|
| 2,291,219 | 7/1942 | Fontecilla | 24/545 |
| 2,566,837 | 9/1951 | Huelsmeyer | 24/67.9 |
| 3,364,528 | 1/1968 | Fletcher | 24/67.1 |
| 3,673,640 | 7/1972 | Brown | 24/30.5 R |
| 3,986,232 | 10/1976 | Teetor | 24/67 R |
| 4,055,874 | 11/1977 | Brown | 24/67.9 |
| 4,241,477 | 12/1980 | Freedom et al. | 24/67.9 |
| 4,706,342 | 11/1987 | Yu | 24/67.3 |

FOREIGN PATENT DOCUMENTS

| | | | |
|---|---|---|---|
| 978127 | 4/1951 | France | 24/67.9 |

*Primary Examiner*—Victor N. Sakran

*Attorney, Agent, or Firm*—Ralph S. Branscomb

[57] ABSTRACT

An improved paper clip is provided which has three modes of use, one of which enables part of the paper clip to extend beyond the clipped papers for easy removal and visibility of the clip, another is partially hidden but partially extended for use as a bookmark, or the like, and the final embodiment is completely rotated against the papers so that it is essentially completely hidden.

4 Claims, 1 Drawing Sheet

PAPER CLIP

BACKGROUND OF THE INVENTION

Traditional paper clips have a major advantage in that they are very cheap to manufacture. Hundreds, if not thousands, of them can be purchased for less than a dollar. However, they have certain disadvantages. First, because there is always a wire end against the paper, there is a tendency for the clip to tear the paper when it is removed. Secondly, once the clip is in place, it is not always clear when looking at a stack of papers, where the paper clip is. It might be necessary, for example, to move a certain group of papers that have been clipped together, but the irregular edges of the papers in the stack make is impossible where the clip is.

Lastly, the typical paper clip has a tendency to be bent out of shape on the first use, making it a nuisance to use.

SUMMARY OF THE INVENTION

The instant paper clip resolves all of the above-stated advantages and comprises not a wire clip as traditional clips are, but a clip fabricated from spring steel or like material with a high memory. Basically, the clip is formed from a single sheet metal stamping that is bent over along one edge to define a bottom panel, a top panel, and a downwardly extending resilient finger which extends beyond the back panel and up somewhat, to make it extremely easy to engage the clip on paper.

By the nature of construction of the clip, there are three modes of operation, depending on whether it is inserted straight onto the paper, rotated 45 degrees or so, or rotated a full 90 degrees so that the edge between the two panels lies flush against the top of the paper.

DETAILED DESCRIPTION OF THE PREFERRED EMBODIMENT

Figure 1:
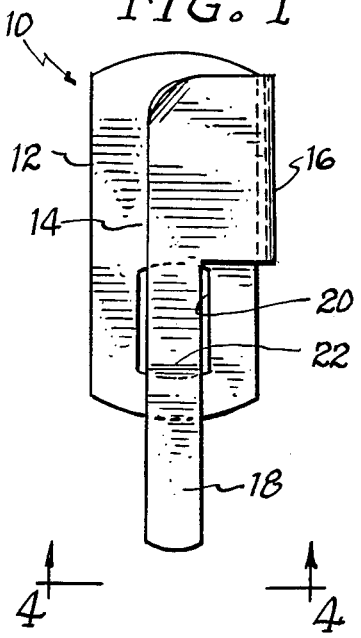
FIG. 1 is a front elevation view of the invention.
Figure 2:
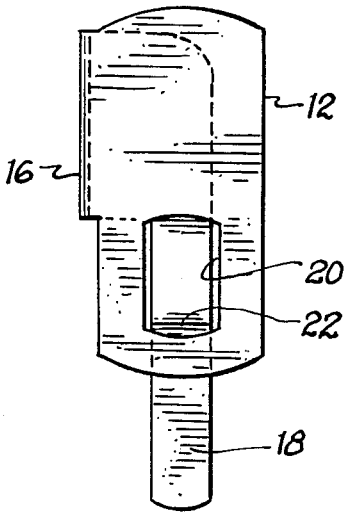
FIG. 2 is a rear elevation view of the clip.
Figure 3:
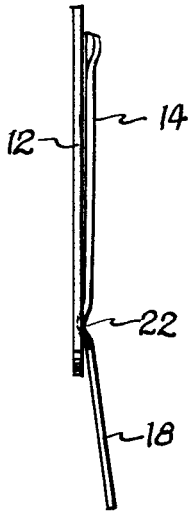
FIG. 3 is a side elevation view of the clip.
Figure 4:
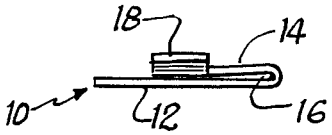
FIG. 4 is an end elevation view taken along line 4—4 of FIG. 1.

The clip is shown at 10 and has a back panel 12, and a front panel 14 which connects to the back panel along the bend 16. These panels are preferably of spring steel and are pressed together fairly tightly to provide the best grip on the papers that they are intended to hold. The front panel has a depending, resilient finger 18 which extends down below the bottom of the back panel 12 as best shown in FIGS. 1 through 3. The long, extended finger enables the clip to be easily engaged over several papers by depressing the finger with the top edges of the paper. The clip fits on paper 24.

Additional features of the clip are the aperture 20, which coincides with an indentation 22 in the finger, which is a slight inward bend which coincide with the aperture 20. This serves the purpose of deforming papers slightly that are engaged in the clip, to enhance the grip of the clip.

Figure 7:
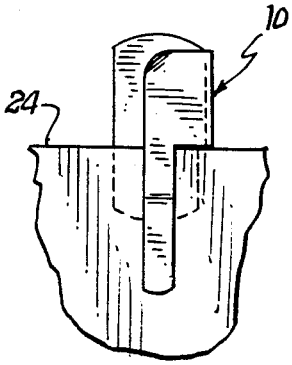
FIG. 7 illustrates the principal use of the clip, with approximately half of the clip extending above the papers.

The principal use of the clip is shown in FIG. 7, in which it engages the papers straight on, with approximately half of the clip or slightly less, extending above the papers. This not only holds the papers together, but serves as a marker which is clearly visible in a stack of papers. It also makes the clip easy to remove, and when removing, there is no possibility that the paper will be torn.

Figure 5:
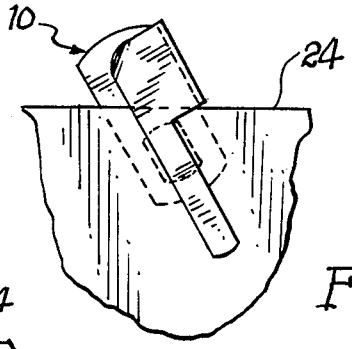
FIG. 5 illustrates the clip in use in its 45 degree rotation mode.

In a second mode shown in FIG. 5, the clip can be rotated approximately 45 degrees, at which point it runs into a natural resistance from the edge of the front panel of the clip, so that it is easy to put in this position unless excess force is applied. This mode of use grips the paper somewhat more firmly than the use illustrated in FIG. 7, and could be used for a book marker, or just as a paper clip as in FIG. 7.

Figure 6:
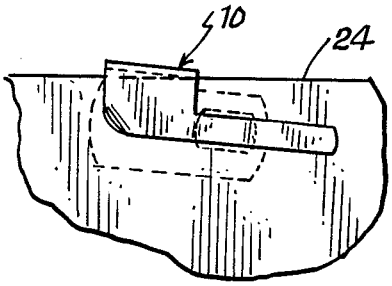
FIG. 6 illustrates the clip completely rotated so that it will be out of sight on the paper.

The last mode is illustrated in FIG. 6. In this mode, the clip is rotated all the way until the edge 16 is flush with the top of the paper. In this mode, the clip is not extended from the papers, and thus is not too much more visible than an ordinary paper clip, although clearly the edge 16 is longer than the edge of a typical paper clip. However, the main advantage of this mode is that the papers are gripped more securely than the other two modes. In addition, when the clip is removed in this mode, since there are no wire ends or sharp edges to tear the paper, there is no chance the paper will be torn.

In all modes of use, the instant clip is superior to existing clips and their improved visibility in use, and even more importantly, their ability not to tear paper when they are removed from the papers to which they are clipped.

I claim:

1. A clip comprising:

(a) a back panel;

(b) a resilient front panel connected to said back panel along the edge thereof adjacent the upper edge of said back panel;

(c) said back panel extending down further than said front panel, and said panels lying substantially flush against one another; and (d) a resilient spring finger extending down from said front panel and being pressed against said back panel and being oriented to at least partially press against paper captured between said front and back panels, wherein said back panel has an opening in the lower portion thereof aligned with said finger such that said finger extends across said opening and extends well past the lower edge of said back panel.

2. A paper clip according to claim 1 wherein said front and back panels are unitary and form a bend therebetween, and said finger defines an inward dent at said opening to depress paper clip between said panels into said opening and continues downward to define not only a pressure point at said dent, but a paper guide, and a pressure-applying area along the length of said finger.

3. The paper clip according to claim 2 wherein said front panel extends only partially across said back panel from said bend in the lateral direction to facilitate inserting papers between said panels.

4. A paper clip according to claim 3 wherein the edge of said front panel which extends furthermost laterally across said rear back panel, which is the edge opposite said bend, is flared up slightly to expedite inserting paper between said panels.

* * * * *